US005206622A

United States Patent [19]

Lattari

[11] Patent Number: 5,206,622

[45] Date of Patent: Apr. 27, 1993

[54] PROTECTOR DEVICE WITH IMPROVED BIMETAL CONTACT ASSEMBLY AND METHOD OF MAKING

[75] Inventor: Michael E. Lattari, Attleboro, Mass.

[73] Assignee: Texas Instruments Incorporated, Dallas, Tex.

[21] Appl. No.: 867,266

[22] Filed: Apr. 10, 1992

[51] Int. Cl.[5] ..... H01H 37/54; H01H 37/52; H01H 71/16

[52] U.S. Cl. ..... 337/89; 337/365; 337/373; 337/379

[58] Field of Search ..... 337/89, 91, 102, 365, 337/372, 373, 374, 379, 380; 29/622

[56] References Cited

U.S. PATENT DOCUMENTS 4,622,739 11/1986 Pejouhy et al. ..... 29/622
4,713,717 12/1987 Pejouhy et al. ..... 337/102
5,021,761 6/1991 Stack et al. ..... 337/91

*Primary Examiner*—Harold Broome
*Attorney, Agent, or Firm*—Russell E. Baumann; Richard L. Donaldson; René E. Grossman

[57] ABSTRACT

The present invention provides an improved thermostatic contact assembly for use in a protector and method of making wherein weld projections are formed on the thin snap-acting bimetal disc for attaching the movable contact member to provide better alignment and reliability for the contact assembly which is economical to produce.

10 Claims, 2 Drawing Sheets

PROTECTOR DEVICE WITH IMPROVED BIMETAL CONTACT ASSEMBLY AND METHOD OF MAKING

This present relates to an improved bimetallic contact assembly and method of manufacture, and more particularly to an improved bimetallic contact assembly resulting from an improved weld and method of manufacture typically for a motor protector device or the like.

BACKGROUND OF THE INVENTION

It has been known in the art to use dish-shaped, snap-acting bimetallic discs with an electrical contact welded to the disc as contact assemblies. Many of these contact assemblies are part of motor protector devices or the like where the dish-shaped thermostatic bimetallic element provides the actuation means for the device. The protector devices are located typically directly adjacent or inside the motor that the device is protecting to provide inherent protection which senses not only over-current conditions but also over-temperature conditions. Since the contact assemblies are current carrying, both the amount of current flowing through the thermostatic element which provides self-heating as well as the ambient temperature determine if a fault condition occurs and consequently can cause the element to snap to an inverted dish-shaped configuration moving the contact on it away from the other stationary contact of the device.

As such protection devices have been designed to operate under more demanding conditions and at more precise "snap" temperatures, the need for highly reliable devices has been become more important including the snap-acting thermostatic dish-shaped element and contact assembly. Additionally, there is always a need to produce the contact assemblies and thus ultimately the total device more economically. Presently the contacts are provided typically in the form of individual button contacts with weld projections on the bottom for welding the contact buttons to the thermostatic element. Such finished welded assemblies as described in U.S. Pat. No. 3,430,177 assigned to the assignee of instant application and incorporated herein by reference have in general been acceptable but there is a need for a more economically produced assembly with very high reliability especially with regard to failure due to contacts "falling off". It is important that any new device design provides both of these stated objectives and does not disturb disc response.

Accordingly, it is an object of the present invention to provide an improved bimetallic contact assembly for use in a protector switch device or the like.

Another object of the invention is to provide a protector device of which the parts thereof are suitable for mass production techniques.

Still another object of this invention is to provide a protector device with an improved bimetallic contact assembly which is reliable in operation and economical to produce.

Yet another object of this invention is to provide a method for producing the improved bimetallic contact assembly of this invention.

Other objects and features of the invention will become more readily understood from the following detailed description and appended claims, when read in conjunction with the accompanying drawings in which like reference numerals designate like parts throughout the figures thereof.

DETAILED DESCRIPTION OF THE INVENTION

Figure 1:
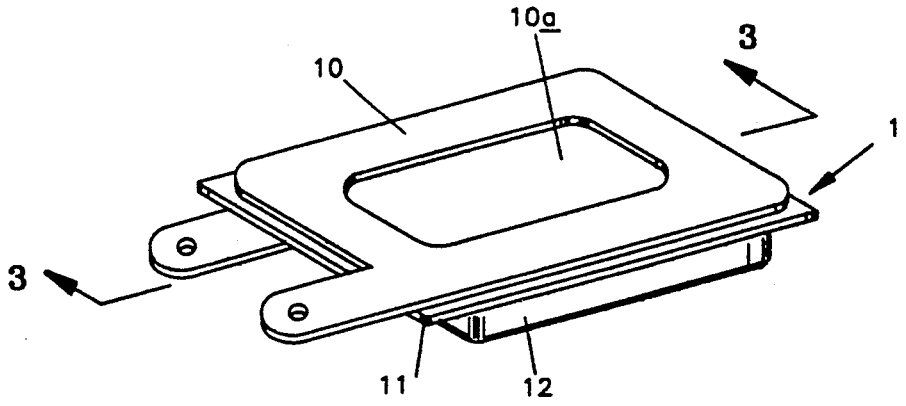
FIG. 1 is a pictorial view of a protector device according to the invention.
Figure 2:
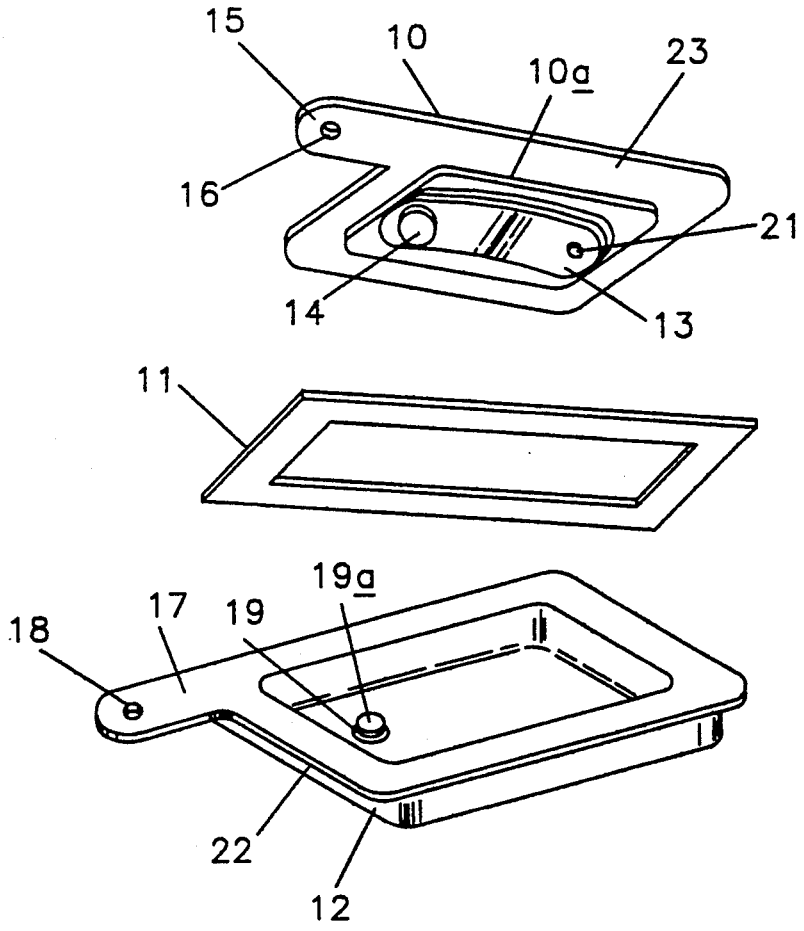
FIG. 2 is an exploded view showing the various parts of device of FIG. 1 including thermostatic bimetal contact assembly.

Referring now to the drawings, FIGS. 1 and 2 show protector 1 as comprising the lid 10, the spacer gasket 11, the thermostatic bimetal member 13 and the can 12. As shown more particularly in FIG. 2, the lid 10 is made of metal having in this instance a rectangular configuration with a lobe 15 having a hole 16 therein for attaching a lead wire from the apparatus to be protected, and a depressed center section 10*a*.

To the underside of the lid 10 in the depressed center section 10i a is welded one end of a curved, snap-acting bimetallic dish-shaped member 13 having a contact 14 of a silver material or the like at its other end to be explained in further detail below. Member 13 is not welded at its end directly to the plate in the embodiment shown, but is held to a spacer 20 by weld button 21 extending through the strip. Although a spacer 20 is used in the specific embodiment, as already stated, a depression formed in the lid 10, similar to indent 19 (referred to below) in the can 12, would function equally well as a spacer to keep the free end of the contact member 13 physically separate from the lid.

The metallic can 12 has a flange-like portion 22 extending around its periphery for mating with the flange-like portion 23 of the lid 10. Contact to the can is provided by the way of lobe 17 having hole 18 therein. At the bottom of the can and at a location predetermined for registry with contact 14 at the free end of the bimetallic member 13, is the raised indent 19 having a contact 19*a* thereon for engaging said contact 14 in the closed position of said member 13. The lid 10 and the can 12 are joined by the gasket 11 which electrically isolates the lid from the can, said gasket joining the two members by engaging their respective flanges. The gasket may be, for example, of Mylar and coated on each side with a thermosetting adhesive material. After the parts have been assembled and properly joined, pressure is applied to the lid 10 and the assembly heated to a temperature sufficient to cure the thermosetting adhesive, but not high enough to deleteriously affect the calibration of member 13, bonding the lid to the can. This method of sealing the parts not only provide good electrical isolation and a tight bond, but also a simple means of fastening the parts without the use of screws or rivets.

Figure 3:
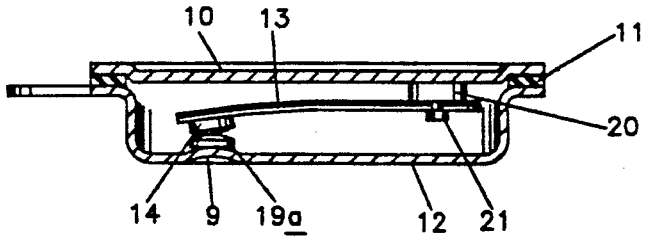
FIG. 3 is a cross-section taken across section line 3—3 of FIG. 1 showing a cross-section of the device along its length with the thermostatic contact assembly, with the contact assembly in the closed position in solid lines and in an open position in dotted lines.

In FIG. 3 the position of the bimetallic member 13 is shown in relation to indent 19 and contact 19*a* thereon after the lid 10 is joined to the can 12. When in position, contact 14, secured to the free end of bimetallic member 13, extends down toward the bottom of the can 12 and engages the contact 19*a*, which serves as the other contact for the switch. As shown in solid lines, the switch is in the ON position, providing a direct electrical path between terminals 15, through spacer 20, bimetallic member 13, contact 14, contact 19*a*, and terminal 17.

In accordance with this invention, member 13 is made from a composite strip made up of two or more metals having different thermal coefficients of expansion, so that a change in temperature will cause unequal expansion and contraction of the opposite faces of the strip. The thin strip is shaped to have a cupped portion, as for example by forming a spherical projection into one face thereof. Thus shaped and constructed, it will be found that, upon raising the temperature, the unequal expansion of the metals constituting the strip will tend to flatten the cupped surface until, at a predetermined temperature, a sudden reversal of flexure of the shape of the strip occurs in the opposite direction, which reversal of shape or flexure will be maintained until the temperature is substantially lowered, at which time, the thermostatic member 13 will suddenly return to its initial shape. In both of these movements, the reversal of curvature is exceedingly abrupt, and is caused by the expansion or contraction of the metals of which the thermostatic member is composed.

To calibrate the switch and insure that it will function within the desired operating range, indent 19 is forced upward by applying pressure to the bottom of the can 12 until the contact 19*a* engages contact 14. Additional pressure is then applied to place an upward force on the thermostatic member 13.

In the above embodiment, contact 14 remains in contact with the contact 19*a* as the temperature rises until reversal or curvature occurs in member 13. At that time, contact 14 breaks with contact 19*a* and opens the circuit to the apparatus being protected.

In many thin bimetallic members, such as member 13, there is a condition which is called "creep". As the temperature rises, the member slowly begins to distort and move up slightly until reversal of curvature occurs. If a slight additional pressure is not applied by indent 19 upon contact 14 through contact 19*a* (and therefor upon member 13), there will be a tendency for the contact 14 to "creep" away from contact 19*a* breaking contact before the critical temperature is reached. However, if an upward pressure is applied on member 13 beyond the pressure necessary for contact 14 to engage contact 19*a*, contact between 19*a* and contact 14 will be maintained until reversal of curvature occurs. In this manner, the breaking temperature of the member 13 may be adjusted by the extent to which indent 19 extends upwardly to engage contact 19*a* with contact 14.

Since both the can 12 and the lid 10 are electrically "hot", they must be insulated from all metallic surfaces. This may be done by surrounding the switch with a heat shrinkable insulating tubing or encapsulating it in several varieties of epoxy resins available in the market.

Due to the adhesive bond between the lid and the can, the switch may be immersed in such media as motor winding varnish or pitch of the kind used in fluorescent light ballast, without having the inside of the switch contaminated.

In FIG. 3 the open position of the protector switch is shown by dotted lines. It may be noted that the thermostatic member 13 may strike the underside of the lid 10. This may be used to advantage to limit the travel of the member, thus increasing its useful life.

Figure 4:
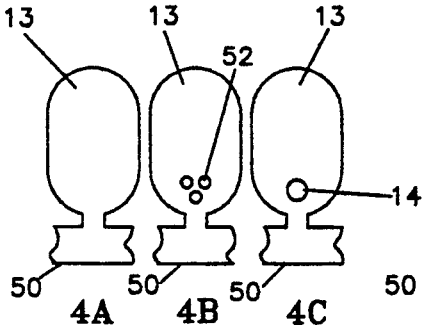
FIG. 4A, is a pictorial view of the bimetallic disc of this invention on carrier strip.
FIG. 4B is a pictorial view of the bimetallic disc of Figure A with weld projections.
FIG. 4C is a pictorial view of the bimetallic disc of FIG. 4A with contact attached.
Figure 5:
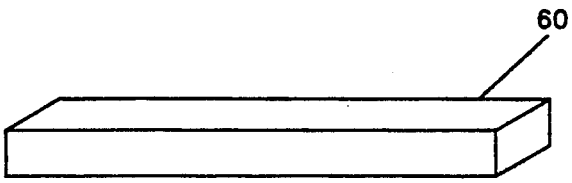
FIG. 5 is a pictorial view of the contact strip of this invention.

In accordance with this invention as shown in FIGS. 4A, 4B and 4C, a thin bimetallic strip 50 is blanked into discs 13 in a continuous manner with weld projections 52 preferably more than one formed in the disc for welding the contact 14 to the disc. It is to be understood that the blanked disc 13 at this stage is typically still part of a continuous strip although the disc 13 could be blanked into separate pieces. Contacts 14 can now be provided in continuous flat strip form 60 without the need for any weld projections for a simple automated process for making the bimetallic contact assembly. In one continuous process the contact strip 60 is continuously fed, cut, positioned on the disc and then resistance welded, as is known in the art, to the continuous disc strip at the location of the weld projections on the disc. Typically a forming of the contact is then carried out. This operation provides the desired contact configuration and also controls spacing between contact and disc which is important for contact adherence. Lastly, the disc with contact is formed into its dish-shaped contour to provide the desired snap-acting properties. This process and bimetallic contact assembly structure provides a highly reliable assembly with the contact precisely and securely welded to the disc in an economical, automated process.

In the prior art, the weld projections were formed as part of a relatively thick formed contact button. These individual buttons in turn were then welded on the discs. This process and contact assembly structure necessitates the use of more costly button contacts and processing operations. Additionally, it was found with the present invention that the contact adherence especially with the use of a plurality of weld projections on the bimetal and preferably with three projections was superior with minimal contact "fall off" problems. Contact alignment and positioning on the disc were also improved as well as controlled spacing between contact and disc. This design and process was not used before because of the relatively thin dimension of the bimetallic material (0.005 inches) and the fear that the projections might effect the properties of the disc. It was unexpectedly found, however, that projections of a general height between 0.005 and 0.009 and a nominal diameter of between 0.015 and 0.025 provided excellent actuation properties so that the contact assemblies performed consistently and there was minimum contact "fall off".

Although the present invention has been shown and illustrated in terms of specific preferred embodiments, it will be apparent that changes and modifications are possible without departing from the spirit and scope of the invention as defined in the appended claims.

I claim:

1. A contact assembly for use in a protector device comprising a thin snap acting thermostatic member with at least one weld projection formed as an integral part of said thermostatic member and a contact member for attaching to the thermostatic member by welding using the at least one weld projection for an accurate reliable contact assembly.

2. The contact assembly of claim 1 having a plurality of weld projections on said member.

3. The contact assembly of claim 1 having three weld projections on said member.

4. A contact assembly of claim 1 wherein said at least one weld projection has a height of between 0.005 and 0.009 l of an inch.

5. The contact assembly of claim 4 wherein the nominal diameter of the at least one weld projection is between 0.015 and 0.025 of an inch.

6. In a thermostatic protector having an electrically conductive can, an electrically conductive lid for closing said can to form a housing, an electrically insulative means interposed between said can and said lid member, a movable thermostatic contact assembly mounted on one of said can and said lid members, a stationary contact mounted on the other of said can and said lid members, said contact assembly having a contact on a thin thermostatic member so that said movable contact is movable into an out of engagement with said stationary contact, and terminals attached to said lid and said can, the improvement comprising said thermostatic member having weld projection means formed as an integral part of said thermostatic member for reliably and accurately attaching said movable contact to said thermostatic member.

7. The thermostatic protector of claim 4 wherein said weld projection means is a plurality of weld projections on said thermostatic member.

8. The thermostatic protector of claim 4 wherein said weld projection mean sis three weld projections.

9. The thermostatic protector of claim 4 wherein said weld projection means has at least one weld projection with a height of between 0.005 and 0.009 of an inch.

10. The thermostatic protector of claim 4 wherein said weld projection means has at least one weld projection with a nominal diameter of between 0.015 and 0.025 of an inch.

* * * * *